United States Patent [19]

Schultz

[11] 4,109,599

[45] Aug. 29, 1978

[54] METHOD OF FORMING A PRESSURE RESISTANT END SHELL FOR A CONTAINER

[75] Inventor: Freddy R. Schultz, Lower Burrell, Pa.

[73] Assignee: Aluminum Company of America, Pittsburgh, Pa.

[21] Appl. No.: 848,517

[22] Filed: Nov. 4, 1977

[51] Int. Cl.[2] ..... B21D 51/44

[52] U.S. Cl. ..... 113/121 C

[58] Field of Search ..... 113/1 F, 121 R, 121 C; 220/66, 70, 270, 273; 72/348

[56] References Cited

U.S. PATENT DOCUMENTS

| | | | |
|---|---|---|---|
| 1,385,290 | 7/1921 | Welling | 113/121 C |
| 2,017,460 | 10/1935 | Hothersall | 113/121 C |
| 3,417,898 | 12/1968 | Bozek et al. | 220/66 |
| 3,537,291 | 11/1970 | Hawkins | 72/336 |
| 3,843,014 | 10/1974 | Cospen et al. | 220/66 |
| 4,031,837 | 6/1977 | Jordan | 113/121 C |

*Primary Examiner*—Michael J. Keenan
*Attorney, Agent, or Firm*—William J. O'Rourke, Jr.

[57] ABSTRACT

A method is disclosed for forming an end shell to allow a reduction of the gauge of the end shell without loss of pressure holding capabilities or, alternatively, to increase the pressure resistance of the container to which the end shell is secured. This method comprises the steps of providing a sheet metal end shell having a substantially planar central wall portion, a first curved portion around the periphery of the central wall portion connecting the central wall portion with an integral frustoconical wall portion, a peripheral flange projecting radially outwardly from and integral with the frustoconical wall portion, and exterior and interior surfaces respecting its intended use on a container; supporting the central wall portion with a first supporting means disposed against the interior surface thereof opposite said frustoconical wall portion substantially concentrically of the end shell to within less than approximately 97.5% of the diameter of the central wall portion; supporting the peripheral flange with a second supporting means disposed against at least a portion of the exterior surface thereof; and reducing the distance between the peripheral flange and the central wall portion by moving at least one of the supporting means toward the other to form the outer peripheral portion of the central wall portion downwardly and inwardly toward the first supporting means into the shape of a reinforcing channel around the central wall portion.

14 Claims, 8 Drawing Figures

METHOD OF FORMING A PRESSURE RESISTANT END SHELL FOR A CONTAINER

BACKGROUND OF THE INVENTION

The present invention relates to a method of forming a pressure resistant end shell for a container. More particularly, this invention relates to a method of forming a reinforcing channel in a generally disc-shaped end shell by a controlled bending or folding operation in which a portion of a substantially planar central wall portion defining the bottom recess of the disc-shaped end shell is raised as the peripheral reinforcing channel is formed therearound.

It has been taught in the prior art that a conventional can end may have its pressure resistance increased by increasing the depth of the annular groove with respect to the central panel and maintaining a tight radius of curvature in the annular groove. Prior art patents disclosing deeper than normally experienced annular grooves with tight radii of curvature for the purpose of increasing pressure holding capabilities, buckle resistance and the like include U.S. Pat. Nos. 4,031,837; 3,417,898 and 3,843,014. In particular, U.S. Pat. No. 4,031,837 teaches a method of reforming a conventional can end by moving a drawing tool into the conventional annular groove while supporting the central panel to draw the metal, and thereby increase the depth of the annular groove with respect to the central panel.

When seamed onto a container, such can ends having relatively deep annular grooves have been found to be able to withstand increased internal pressures without buckling. It has thus become possible to reduce the gauge thickness of the can end about 10 to 20 percent while maintaining internal pressure resistance capabilities of the conventional can end.

It has become apparent that drawing a deeper than conventional annular groove has an overall effect of increasing the pressure holding capabilities of a container even though two dichotomous principles are at work. First, the deepening of the annular groove and the tightening of its radius of curvature act to increase pressure resistance. However, drawing has the effect of thinning the metal which acts to decrease pressure resistance. It follows, logically, that a method of forming a deep annular groove having a tight radius of curvature, without thinning the sheet metal would result in a can end having superior pressure resistant capabilities.

Accordingly, a new and improved method of forming a pressure resistant end shell without thinning of the sheet metal is desired to further increase the pressure holding capabilities of the container to which the end shell is secured or, alternatively, permit further reduction of gauge thickness of the end shell without loss of pressure holding capabilities.

SUMMARY OF THE INVENTION

This invention may be summarized as providing a new and improved method for forming a pressure resistant end shell for a container in which the thickness of the end shell is not reduced in the final forming operation. This method comprises the steps of providing a sheet metal end shell having a substantially planar central wall portion, a first curved portion around the periphery of the central wall portion connecting the central wall portion with an integral frustoconical wall portion, a peripheral flange projecting radially outwardly from and integral with the frustoconical wall portion, and exterior and interior surfaces respecting its intended use on a container; supporting the central wall portion with a first supporting means disposed against the interior surface thereof opposite said frustoconical wall portion substantially concentrically of the end shell to within less than approximately 97.5% of the diameter of the central wall portion; supporting the peripheral flange with a second supporting means disposed against at least a portion of the exterior surface thereof; and reducing the distance between the peripheral flange and the central wall portion by moving at least one of the supporting means toward the other to form the outer peripheral portion of the central wall portion downwardly and inwardly toward the first supporting means into the shape of a reinforcing channel around the central wall portion.

Among the advantages of the subject invention is the provision of a method for forming an end shell for a container of reduced gauge or thickness which is able to resist buckling at relatively high internal container pressures.

Another advantage of the present invention is the provision of a method of forming a pressure resistant end shell for a container which will permit the use of alloys having lower tensile strength.

Another objective of the invention is to provide a method of finally forming a generally disc-shaped end shell into an end shell having a deep reinforcing channel with a tight radius of curvature without resulting in any reduction in the gauge thickness of the metal being formed and perhaps even resulting in some thickening of the gauge thickness of the metal.

These and other advantages and objectives of the invention will be more thoroughly understood and appreciated with reference to the following description and the accompanying drawings.

DESCRIPTION OF THE PREFERRED EMBODIMENTS

Figure 1:
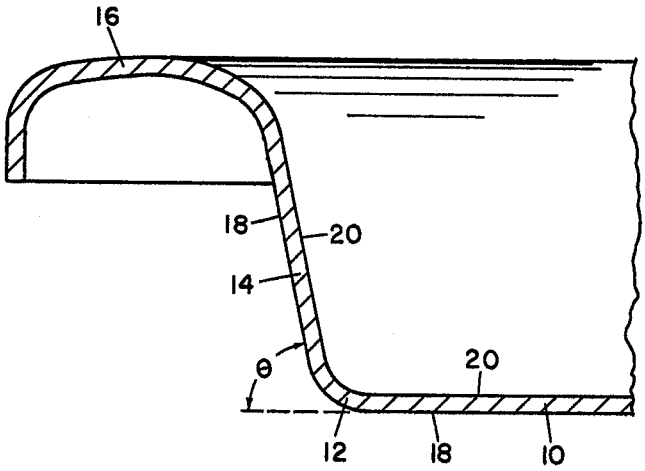
FIG. 1 is an enlarged, fragmentary, cross-sectional view of a disc-shaped end shell before it has been bent into a pressure resistant end shell according to the present invention.

Referring particularly to the drawings, FIG. 1 illustrates a typical sheet metal end shell having interior and exterior surfaces 18 and 20, respectively, with respect to the interior and exterior of a container when the end shell is secured thereon. The end shell includes a substantially planar central wall portion 10 and a first curved portion 12 around the periphery of the central wall portion 10, connecting the central wall portion with an integral frustoconical wall portion 14. The frustoconical wall portion, or chuckwall, 14 projects upwardly and outwardly with respect to the exterior surface 20 of the central wall portion 10 at an angle $\theta$ of from 75° to 90°, and preferably from 77° to 90°. A peripheral flange 16 projects radially outwardly from and is integral with the outer edge of the chuckwall 14.

Figure 3:
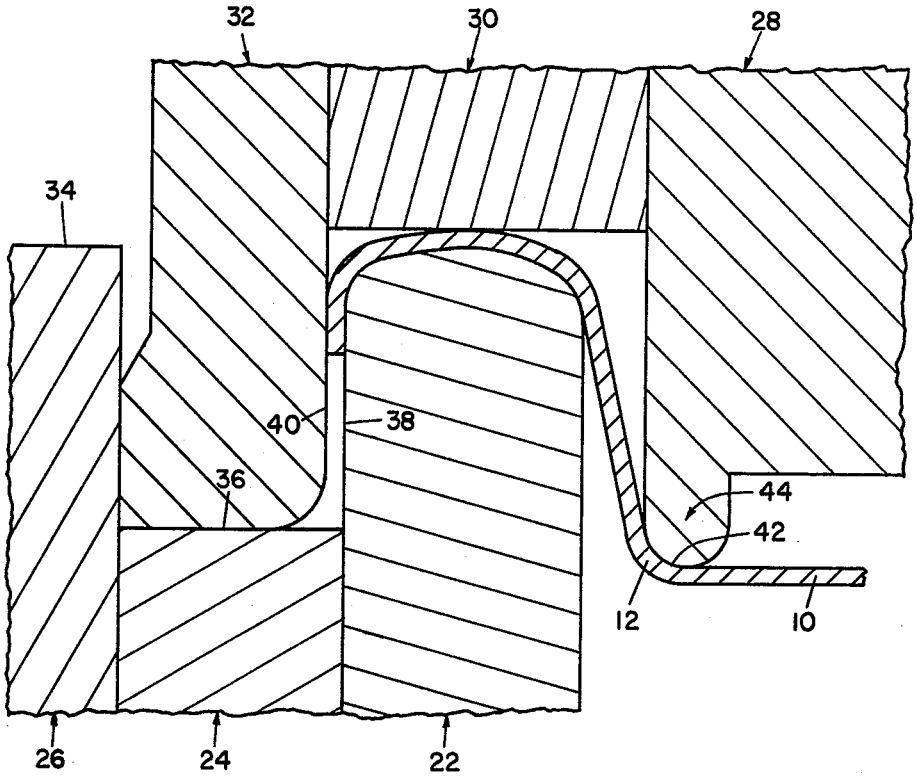
FIG. 3 is an enlarged, fragmentary, cross-sectional view through the dies used for cutting a blank of sheet metal and forming the blank into a disc-shaped end shell.

FIG. 3 illustrates exemplary tools which may be employed to cut a blank from a sheet of metal and form the blank into the configuration shown in FIG. 1. The lower die set includes an annular ring 22, a spring-loaded pad 24 around the annular ring 22 and a shearing ring 26 around the pad 24. The upper die set includes a circular punch core insert 28, a knockout tool 30 around the insert 28 and a punch cut tool 32 around the knockout tool 30. The above-described tools are similar to those used to form a conventional end shell except that a centrally located die core insert has been removed from the lower die set.

In the operation of the dies to the position illustrated in FIG. 3, the peripheral edge portion of the sheet metal inserted therebetween has been sheared through the conjoint action of a top surface 34 of the stationary shearing ring 26 and a bottom surface 36 of punch cut tool 32, as the tool 32 is moved downwardly past the shearing ring 26. After the peripheral edge is sheared, the circular blank is pulled between the tools 24 and 32 inwardly and upwardly between the outside surface 38 of the annular ring 22 and the inside surface 40 of the punch cut tool 32. As the upper dies are moved further against the lower surface, a bottom surface 42 of a downwardly projecting ridge 44 on the punch core insert 28 proceeds downwardly into an unrestricted area to form the first curved portion 12 in the circular blank positioned therebetween. The radius of curvature of the first curved portion approximates that of the outside surface of the projecting ridge 44. In this first forming operation of the present invention, the punch core insert 28 need not have a projecting ridge 44 thereon, and instead may have a substantially planar bottom surface. In practicing the first forming step of the present invention, however, those skilled in the art may find it easier and less expensive to use existing tools which include a punch core insert 28 with a projecting ridge 44. Since the area below the punch core insert is unrestricted, the central wall 10 formed in this first operation will be substantially planar. It should be understood that a certain amount of drawing of the sheet metal may occur in the above-described first forming operation, but such drawing is conventional and not detrimental to the method of the present invention when considered as a whole.

The next step in forming the end shell is the curling operation (not shown) performed on the peripheral flange 16 of the end shell shown in FIG. 3. In the well known curling operation, the flange 16 of the end shell is rotated around a conventional curling roll in a known manner to provide a curl 50 on the downward peripheral flange 16.

Figure 4:
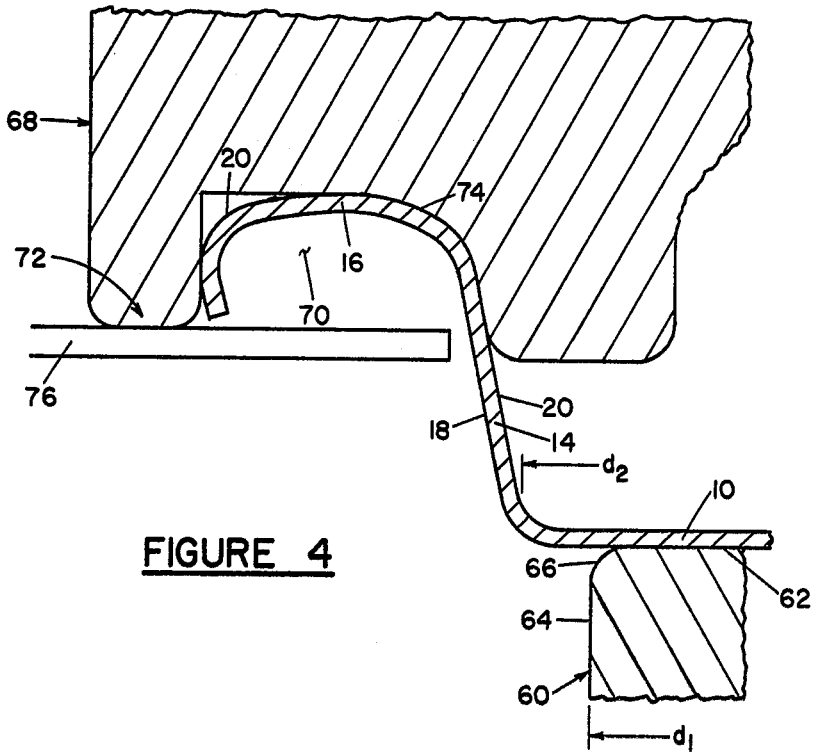
FIG. 4 is an enlarged, fragmentary, cross-sectional view through dies used for bending the end shell shown in FIG. 1 into a pressure resistant end shell in accordance with the present invention.
Figure 5:
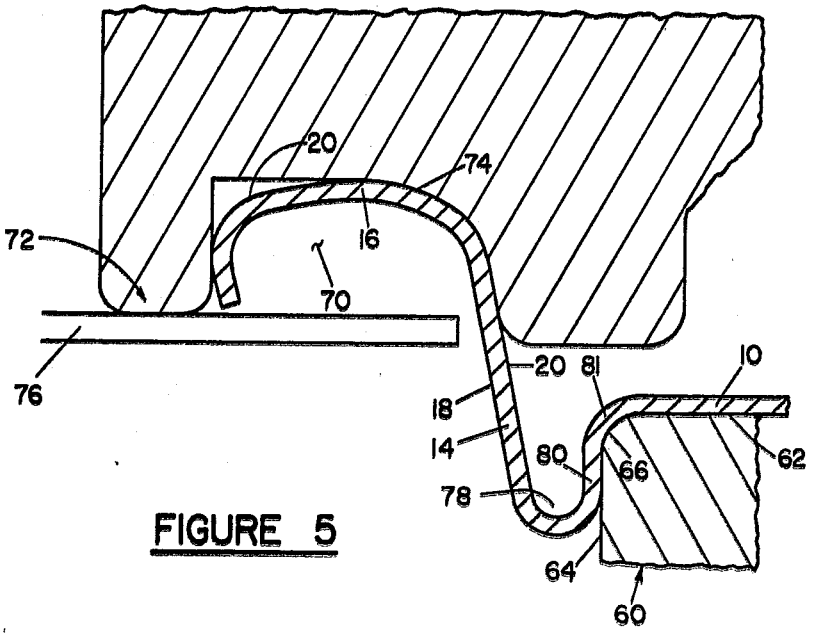
FIG. 5 is an enlarged, fragmentary, cross-sectional view similar to FIG. 4, showing completion of the bending of the pressure resistant end shell.

FIGS. 4 and 5 illustrate opposing dies which may be used to form the pressure resistant metallic end shell in accordance with the present invention. The bottom die core insert 60 may have a generally planar top surface 62. Top surface 62 may, however, be upwardly domed slightly, having a radius of curvature on the order of approximately seven inches. The top surface 62 and outside surface 64 intersect at rounded corner 66, having a radius of curvature of from approximately 0.020 to 0.040 inch and, preferably, approximately 0.030 inch. The circular top surface 62 of the die core insert 60 is substantially in concentric relationship to the central wall portion 10 supported thereon, and the diameter $d_1$ of the top surface 62 is, at least, approximately $2\frac{1}{2}$ percent less than the diameter $d_2$ of the central wall 10 of the end shell. The top die 68 is provided with a recess 70 into which the peripheral flange 16 of the end shell fits. An annular ridge 72 defining the outside dimension of the recess 70 preferably has a height substantially equal to the height of the peripheral flange 16. The inside supporting surface 74 of the recess 70 preferably mates with the exterior surface 20 of a portion of the end shell along the peripheral curl 16 and the chuckwall 14.

In practicing the method of the present invention, an end shell, such as that illustrated in FIG. 1, may be seated in an aperture in a flexible metal conveyor belt 76 and transported to the dies shown in FIGS. 4 and 5 which may be in a conversion press. After the end shell is positioned between the dies, the top die 68 is moved downward toward the stationary die core insert 60. Such downward travel causes the peripheral curl 16 of the end shell to seat in the recess 70 and thereby dispose the central wall portion 10 of the end shell in concentric relationship with the top surface 62 of the die core insert 60. As the top die 68 continues its downward travel, the inside surface 74 of the recess mates with and supports at least a portion of the exterior surface 20 of the end shell about the peripheral curl 16. Concurrently, the top surface 62 of the die core insert 60 is disposed against and supports the interior surface 18 of the central wall portion 10. Continued movement of the top die 68 toward the stationary die core insert 60 pushes the end shell into compression. Further downward movement of the top die 68 and the end shell to the position illustrated in FIG. 5 reduces the distance between the peripheral flange 16 and the central wall portion 10 by raising the central wall portion 10 with respect to its disposition at the bottom of the chuckwall 14 which folds or bends the metal at the bottom of the chuckwall 14 and forms a reinforcing channel, or an annular groove, 78 around the raised central wall portion 10. The annular groove 78 is bounded on the inside by an inner wall 80 and on the outside by the chuckwall 14. The shape of the inner wall 80 and the second curved portion 81, which integrally connects the inner wall 80 with the raised central wall portion 10, conforms substantially to the shape of the respective surfaces including an outer cylindrical wall 64 of the die core insert 60. Preferably, the inner wall 80 is disposed substantially perpendicularly to the central wall portion 10, and the radius of curvature of the second curved portion 81 is approximately 0.020 to 0.040 inch and, more preferably, 0.030 inch.

When the end shell is put into compression and bent subject to stress in the final forming operation described above, no drawing of the metal results which would thin the metal end shell. In fact, the gauge thickness of the sheet metal may actually increase as much as 0.0005 inch at the bottom of the annular groove 78.

The radius of curvature of the annular groove 78 formed in accordance with the present invention may vary, however, it should be understood that the tighter the radius of curvature, the more pressure resistant the end shell. A radius of curvature as tight as 0.008 inch may be formed in conventional aluminum 5182 alloy end shell, in H-19 temper when bent over a 2.320 diameter die core insert. It will be further understood that the radius of curvature of the annular groove 78 depends upon the diameter of the die core insert 60 with respect to the diameter of the central wall portion 10 of the disc-shaped end shell shown in FIG. 1. The diameter of the die core insert 60 must be at least 2½ percent less than the diameter of the central wall portion 10 in order for the controlled bending to occur. Otherwise, the chuckwall 14 of the end shell could be deformed between the dies. The diameter of the die core insert 60 cannot, however, be too much smaller than that of the central wall portion 10. In particular, it must be large enough at least to form an annular groove 78 in a disc-shaped end shell.

Figure 2:
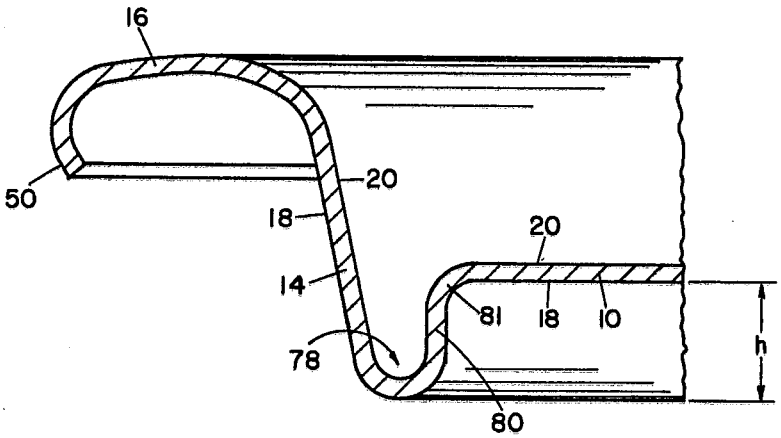
FIG. 2 is an enlarged, fragmentary, cross-sectional view of a pressure resistant end shell formed in accordance with the present invention.

FIG. 2 illustrates the sheet metal end shell shown in FIG. 1 after the reinforcing channel, or annular groove, 78 has been formed in accordance with the present invention. In comparison to the end shell shown in FIG. 1, the central wall portion 10 of the end shell shown in FIG. 2 is raised toward the peripheral flange 16, and an annular groove 78 is formed around the raised central wall portion 10. The annular groove 78 is bounded on the outside by the chuckwall 14 and is bounded on the inside by an inner wall 80. In a preferred embodiment, the central wall portion 10 is raised toward the peripheral flange 16 such that it is disposed at a height *h* of from 0.070 to 0.090 inches above the bottom of the annular groove 78. By increasing this height *h*, the pressure resistance of the end shell is increased, as explained in more detail below.

Figure 6:
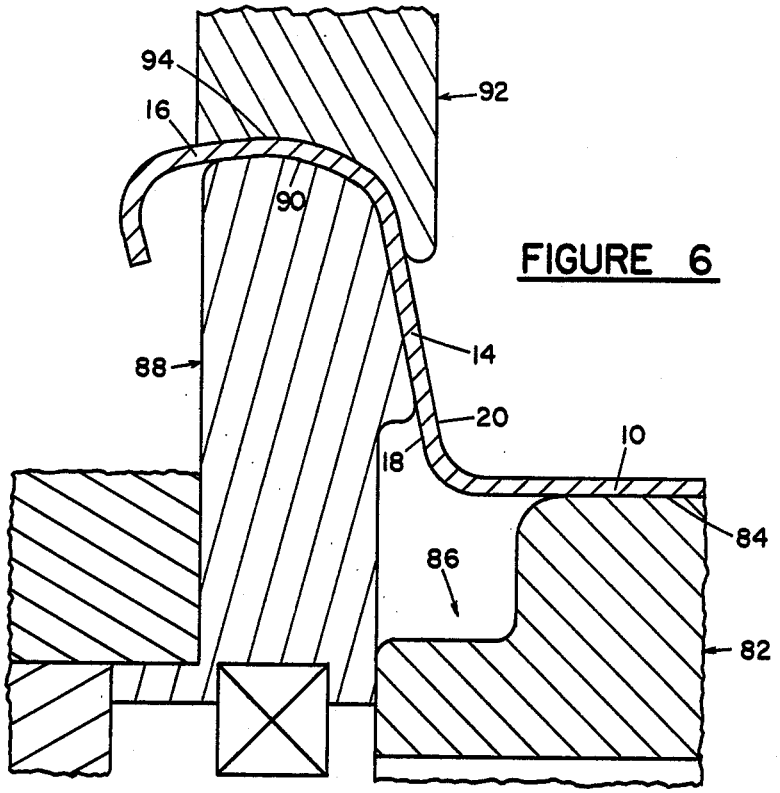
FIG. 6 is an enlarged, fragmentary, cross-sectional view through alternative dies used for bending the end shell shown in FIG. 1 into a pressure resistant end shell in accordance with the present invention.
Figure 7:
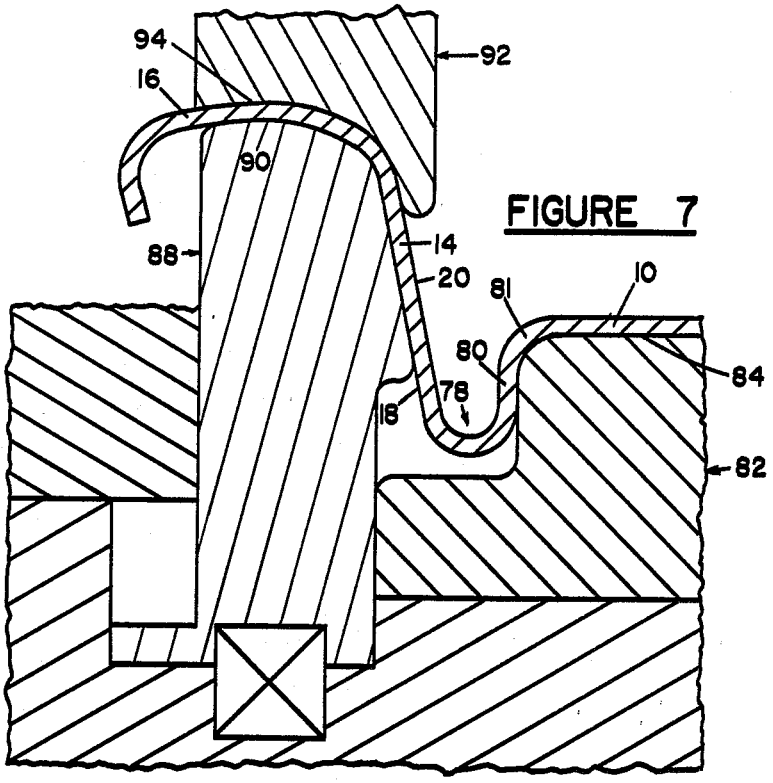
FIG. 7 is an enlarged, fragmentary, cross-sectional view similar to FIG. 6 showing completion of the bending of the pressure resistant end shell.

FIGS. 6 and 7 illustrate alternative tools which may be used to form a pressure resistant end shell in accordance with the present invention. The bottom die set includes a stationary die core insert 82 having a substantially planar circular top supporting surface 84 and an annular step 86 around the periphery. A spring-loaded ring 88 around the die core insert 82 has a top surface 90 which substantially mates with the inside surface 18 of the disc-shaped end shell along a portion of the peripheral curl 16 and the chuckwall 14. The top die 92 shown in FIGS. 6 and 7 has a bottom supporting surface 94 which substantially mates with the outside surface 20 of the disc-shaped end shell along at least a portion of the peripheral curl 16 and the frustoconical wall portion, or chuckwall, 14 opposite the top surface 90 of the spring-loaded ring 88.

In the operation of the tools illustrated in FIGS. 6 and 7, a disc-shaped end shell, such as that shown in FIG. 1, is inserted between the tools such that the peripheral curl 16 of the end shell sits upon the spring-loaded ring 88. When the shell seats upon the ring 88, the circular top supporting surface 84 of the die core insert 82 is substantially in concentric relationship to the central panel 10 of the end shell. The diameter of the top supporting surface 84 is at least approximately 2½ percent less than the diameter of the central wall 10 of the disc-shaped end shell.

After the end shell is seated in the bottom tools, the top die 92 is moved downward toward the end shell, and the bottom surface 94 of the top die 92 engages, and thereby supports, the outside surface 20 of the end shell about the peripheral curl 16. Continued movement of the top die 92 pushes the end shell and the oppositely disposed spring-loaded ring 88 downward and places the end shell into compression with the stationary die core insert 82, the top surface 84 of which is concurrently supporting the interior surface 18 of the central wall portion 10. Further downward movement of the top die 92, the end shell and the spring-loaded ring 88 to the position illustrated in FIG. 7 reduces the distance between the peripheral flange and the central wall portion 10 by raising the central wall portion 10 with respect to its disposition at the bottom of the chuckwall 14 which folds or bends the metal at the bottom of the chuckwall 14 and forms a reinforcing channel, or an annular groove, 78 around the raised central wall portion 10.

The annular groove 78 is formed inside the annular step 86 around the die core insert 82. Therefore, the depth of the annular step 86 should be such that it does not detrimentally interfere with the bending operation. The formed annular groove 78 is bounded on the inside by an inner wall 80, which is integrally connected to the raised central wall portion 10 by a second curved portion 81. Preferably, the inner wall 80 is disposed substantially perpendicularly to the central wall portion 10, and the radius of curvature of the second curved portion 81 is approximately 0.020 to 0.040 inch and more preferably 0.030 inch. Such radius curvature of the second curved portion 81 of the end shell will substantially equal the radius of curvature of the corresponding curved surface around the periphery of the die core insert.

Figure 8:
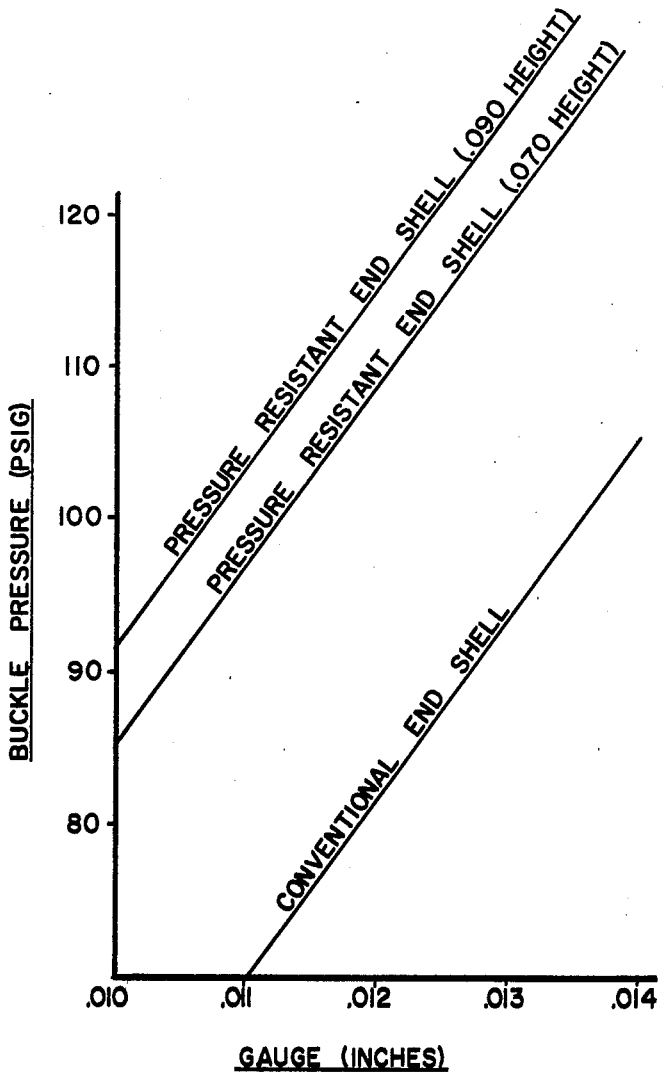
FIG. 8 is a graph comparing the pressure at which a conventional can end and a pressure resistant end shell will buckle at various gauges.

A sheet metal end shell formed in accordance with the present invention is better able to resist internal pressure when applied to a cylindrical can body. Therefore, the gauge thickness of the end shell formed by the present method may be reduced or an alloy possessing a lower tensile strength may be utilized without loosing pressure holding capabilities with corresponding savings in the cost of an end shell. To illustrate the increased pressure resistance, a conventional end shell in light gauge sheet metal of 5182 aluminum alloy in coated, extra hard temper (H-19) at 0.0127 inch gauge was applied to a can body and pressure tested. Such conventional end shell buckled at an internal pressure of approximately 89 pounds per square inch. For comparison purposes, an end shell formed in accordance with the present invention in the same alloy and temper, but having a 0.0103 inch gauge, was applied to a can body and pressure tested. This end shell buckled at an internal pressure of between 85 and 91.5 pounds per square inch depending upon panel height. These results are illustrated graphically in FIG. 8. This graph illustrates the ability to reduce metal gauge by at least approximately 24% in beer and beverage style end shells or to increase the pressure resistant capabilities of a conventional end shell by the same percentage. By reducing the gauge, the base box capacity of RCS (rolled coil sheet) is also increased.

What is believed to be the best mode of this invention has been described above. It will be apparent to those skilled in the art that numerous variations of the illustrated details may be made without departing from this invention. For example, the preferred embodiments illustrate a top die being moved toward a stationary bottom die. This invention equally comprehends any method of either a top die or a bottom die moving toward one another including concurrent movement of both dies.

I claim:

1. A method of forming a pressure resistant end shell for a container comprising the steps of:

providing a sheet metal end shell having interior and exterior surfaces respecting its intended use on a container, a central wall portion in the end shell, a frustoconical wall portion around the central wall portion projecting upwardly and outwardly with respect to the exterior surface of the central wall portion, and a radially outwardly projecting peripheral flange around the outer edge of the frustoconical wall portion;

supporting the central wall portion with a first supporting means disposed against the interior surface thereof opposite said frustoconical wall portion substantially concentrically of the end shell to within less than approximately 97.5% of the diameter of the central wall portion;

supporting the peripheral flange with a second supporting means disposed against at least a portion of the exterior surface thereof; and reducing the distance between the peripheral flange and the central wall portion by moving at least one of the supporting means toward the other to form the outer peripheral portion of the central wall portion downwardly and inwardly toward the first supporting means into the shape of a reinforcing channel around the central wall portion.

2. A method as set forth in claim 1 in which reducing the distance between the peripheral flange and the central wall portion also bends a portion of the frustoconical wall portion inwardly into the reinforcing channel.

3. A method as set forth in claim 1 in which the inward deformation of the peripheral portion of the central wall portion is restricted by an outer wall on the first supporting means.

4. A method as set forth in claim 3 in which the outer wall on the first supporting means is substantially cylindrical.

5. A method as set forth in claim 1 in which the end shell is aluminum.

6. A method as set forth in claim 2 in which the end shell has a gauge in a range of from 0.010 to 0.015 inch.

7. A method as set forth in claim 1 in which the frustoconical wall portion is disposed outwardly at an angle of from 77° to 90° from the plane of the central wall portion.

8. A method as set forth in claim 1 in which the slope of the frustoconical wall portion remains substantially the same after the central wall portion is moved toward the peripheral flange as it was before the central wall portion is so moved.

9. A method as set forth in claim 1 in which the first supporting means comprises a stationary die core.

10. A method as set forth in claim 1 in which the reinforcing channel has a radius of curvature of from approximately 0.008 to 0.020 inch.

11. A method as set forth in claim 1 in which the central wall portion is raised from 0.070 to 0.090 inch with respect to the bottom of the reinforcing channel.

12. A method as set forth in claim 1 in which the inwardly deformed peripheral portion of the central wall portion is substantially perpendicular to the plane of the raised central wall portion.

13. A method as set forth in claim 1 in which the second curved portion connecting the inwardly deformed peripheral portion with the raised central wall portion has a radius of curvature in a range of approximately 0.020 to 0.040 inch.

14. A method of forming a pressure resistant end shell for a container comprising the steps of:

providing a 5182 aluminum alloy end shell of 0.010 to 0.015 inch gauge having a substantially planar central wall portion, a first curved portion around the periphery of the central wall portion connecting the central wall portion with an integral chuckwall, said chuckwall disposed outwardly at an angle of from 77° to 90° from the plane of the central wall, a peripheral flange extending radially outwardly from and integral with the chuckwall, and exterior and interior surfaces with respect to the exterior and interior of a container when the end shell is secured thereon; and moving a first supporting means applied against the exterior surface of the end shell about the peripheral curl toward a second stationary supporting means applied against the interior surface of the central wall portion, said second supporting means disposed substantially in concentric relationship to said central wall portion, and said second supporting means having a diameter at least 2½ percent less than the diameter of the central wall portion to raise the central wall from 0.070 to 0.090 inch with respect to its disposition at the bottom of the chuckwall and to form an annular groove around the raised central wall portion having a radius of curvature of from 0.008 to 0.020 inch, said annular groove bounded on the inside by an inner wall substantially perpendicular to the central wall portion and on the outside by the chuckwall, with said inner wall integrally connected to the raised central wall portion by a second curved portion having a radius of curvature of approximately 0.030 inch, and with the slope of the chuckwall remaining substantially the same after the bending operation.

* * * * *